US008591259B2

(12) United States Patent
Wu

(10) Patent No.: US 8,591,259 B2
(45) Date of Patent: Nov. 26, 2013

(54) CABLE CONNECTOR ASSEMBLY WITH AN IMPROVED SHELL

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/470,552

(22) Filed: May 14, 2012

(65) Prior Publication Data

US 2012/0295482 A1 Nov. 22, 2012

(30) Foreign Application Priority Data

May 19, 2011 (CN) ..... 2011 1 0130257

(51) Int. Cl.
*H01R 13/648* (2006.01)

(52) U.S. Cl.
USPC ..... 439/607.27; 439/607.5

(58) Field of Classification Search
USPC ..... 439/607.27, 607.5, 607.51, 607.48
See application file for complete search history.

(56) References Cited

U.S. PATENT DOCUMENTS

| | | | | |
|---|---|---|---|---|
| 7,690,948 | B2 * | 4/2010 | Lung | 439/607.27 |
| 7,922,532 | B2 * | 4/2011 | Su et al. | 439/607.23 |
| 8,011,960 | B2 * | 9/2011 | Xiao et al. | 439/607.56 |
| 8,142,226 | B2 | 3/2012 | Xiao | |
| 8,328,579 | B2 * | 12/2012 | Sasaki et al. | 439/607.25 |
| 2009/0318026 | A1 * | 12/2009 | Yi et al. | 439/607.24 |
| 2010/0062653 | A1 * | 3/2010 | Mao et al. | 439/660 |
| 2010/0112863 | A1 * | 5/2010 | Xiao et al. | 439/607.27 |
| 2010/0158449 | A1 * | 6/2010 | Yi | 385/75 |

* cited by examiner

*Primary Examiner* — Phuong Dinh
(74) *Attorney, Agent, or Firm* — Ming Chieh Chang; Wei Te Chung

(57) ABSTRACT

A cable connector assembly (100) comprises an insulative housing (1), a number of contacts (2), a cable (6) electrically connected with the contacts, and a metallic shell (3) enclosing the insulative housing. The insualtive housing includes a base portion, a first tongue and a second tongue. The metallic shell comprises a shielding member (31) and an outer shell (32) combined with the shielding member, the outer shell has a continued portion (322) and a T-shaped fixing portion (323) both integrally extending backwardly from two opposing sides thereof, the fixing portion has a clipping portion (3232) extending along a transverse direction on a free end thereof, and opposite free ends of the clipping portion are bent towards each other to clamp the cable while pressing on the continued portion.

13 Claims, 9 Drawing Sheets

CABLE CONNECTOR ASSEMBLY WITH AN IMPROVED SHELL

BACKGROUND OF THE INVENTION

1. Field of the Invention

The present invention generally relates to a cable connector assembly, and more particularly to a cable connector assembly for high speed signal transmission.

2. Description of Related Art

U.S. Pat. No. 8,142,226 issued to Xiao on Mar. 27, 2012 discloses a cable connector assembly in accordance with USB 3.0 standard, the cable connector assembly comprises an insulative housing, a plurality of contacts received in the insulative housing, a metallic shell enclosing the insulative housing and a pair of latches retained in the insulative housing and exposed out of the metallic shell. Tail portions of the contacts are extending beyond a rear end of the insulative housing to be electrically connected with a cable.

The metallic shell of the cable connector assembly comprises two-pieces configuration along an up-to-down direction, to crimp the cable and shield an electrical connection between the cable and the contacts. However as the trend of miniaturization, the cable connector assembly with two-pieces configuration may have a larger height, and it's need to assemble the two pieces members along the up-to-down direction to form a whole shielding member.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved shell.

In order to achieve the above-mentioned object, a cable connector assembly in accordance with the present invention comprises an insulative housing, a number of contacts, a cable electrically connected with the contacts, and a metallic shell enclosing the insulative housing. The insualtive housing includes a base portion, a first tongue and a second tongue. The metallic shell comprises a shielding member and an outer shell combined with the shielding member, the outer shell has a continued portion and a T-shaped fixing portion both integrally extending backwardly from two opposing sides thereof, the fixing portion has a clipping portion extending along a transverse direction on a free end thereof, and opposite free ends of the clipping portion are bent towards each other to clamp the cable while pressing on the continued portion.

Other objects, advantages and novel features of the invention will become more apparent from the following detailed description of the present embodiment when taken in conjunction with the accompanying drawings.

DETAILED DESCRIPTION OF THE INVENTION

Figure 1:
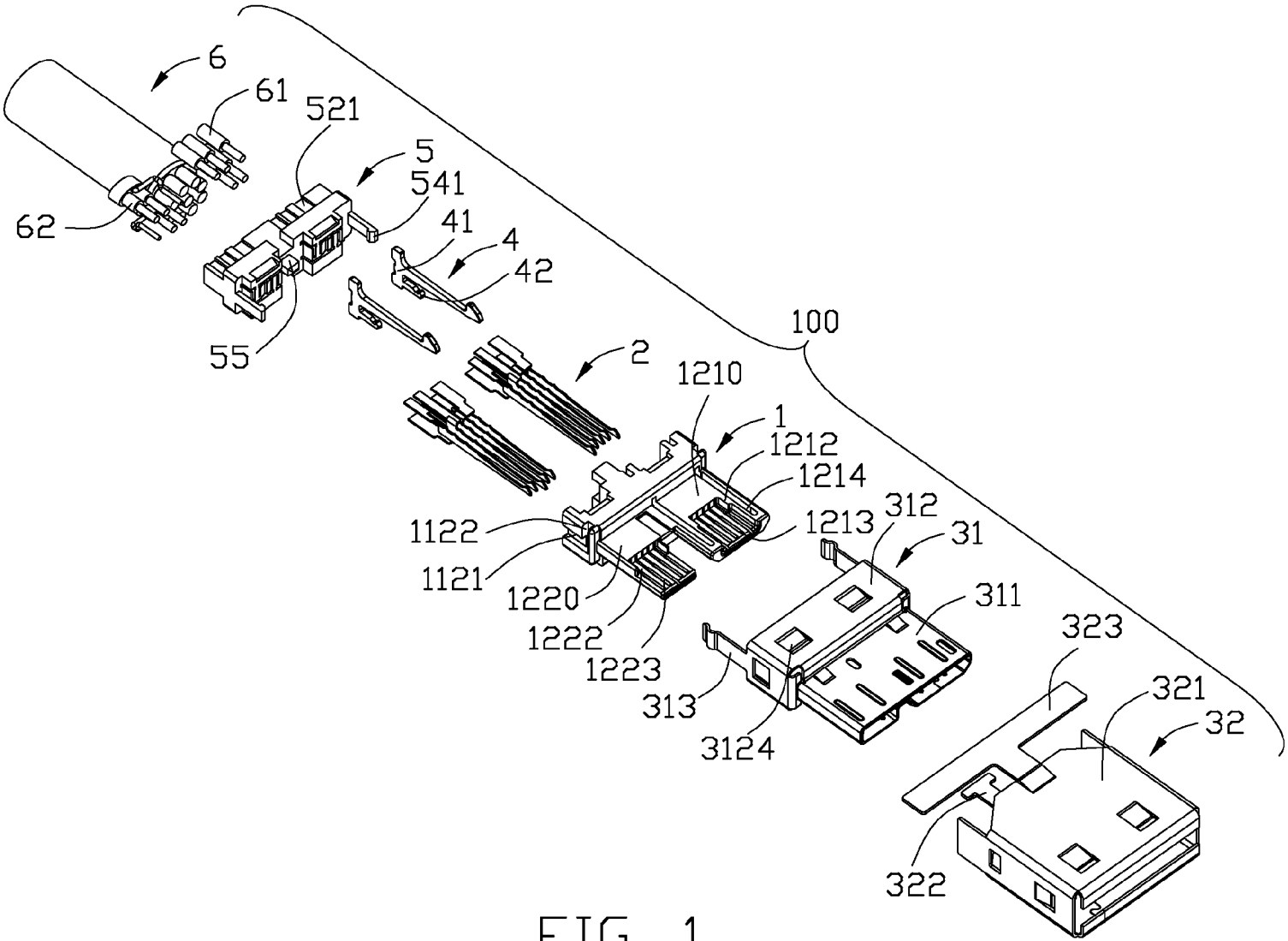
FIG. 1 is an exploded, perspective view of a cable connector assembly in accordance with the present invention.

Reference will now be made to the drawing figures to describe the present invention in detail.

Figure 2:
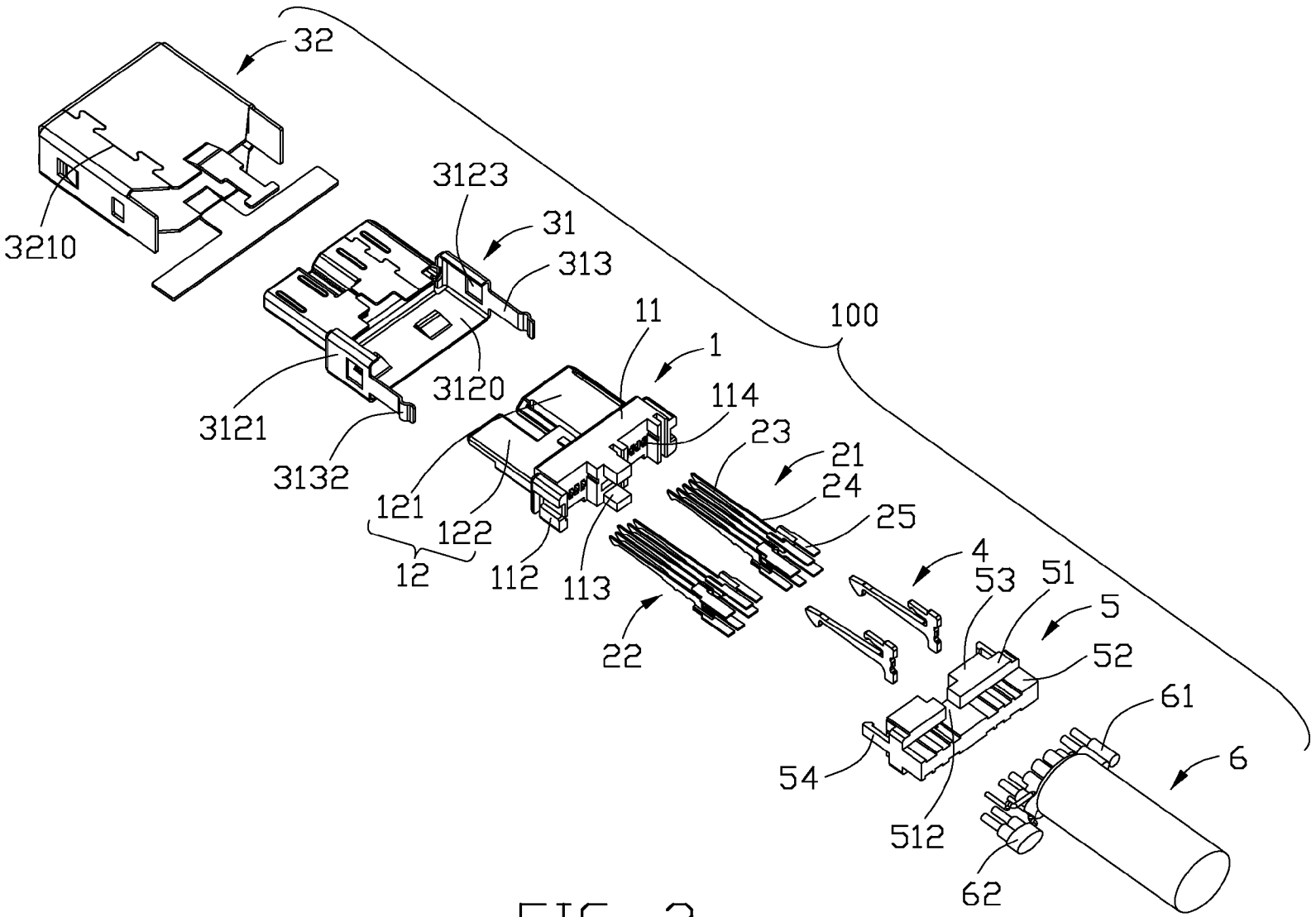
FIG. 2 is a view similar to FIG. 1, but viewed from a different angle.
Figure 3:
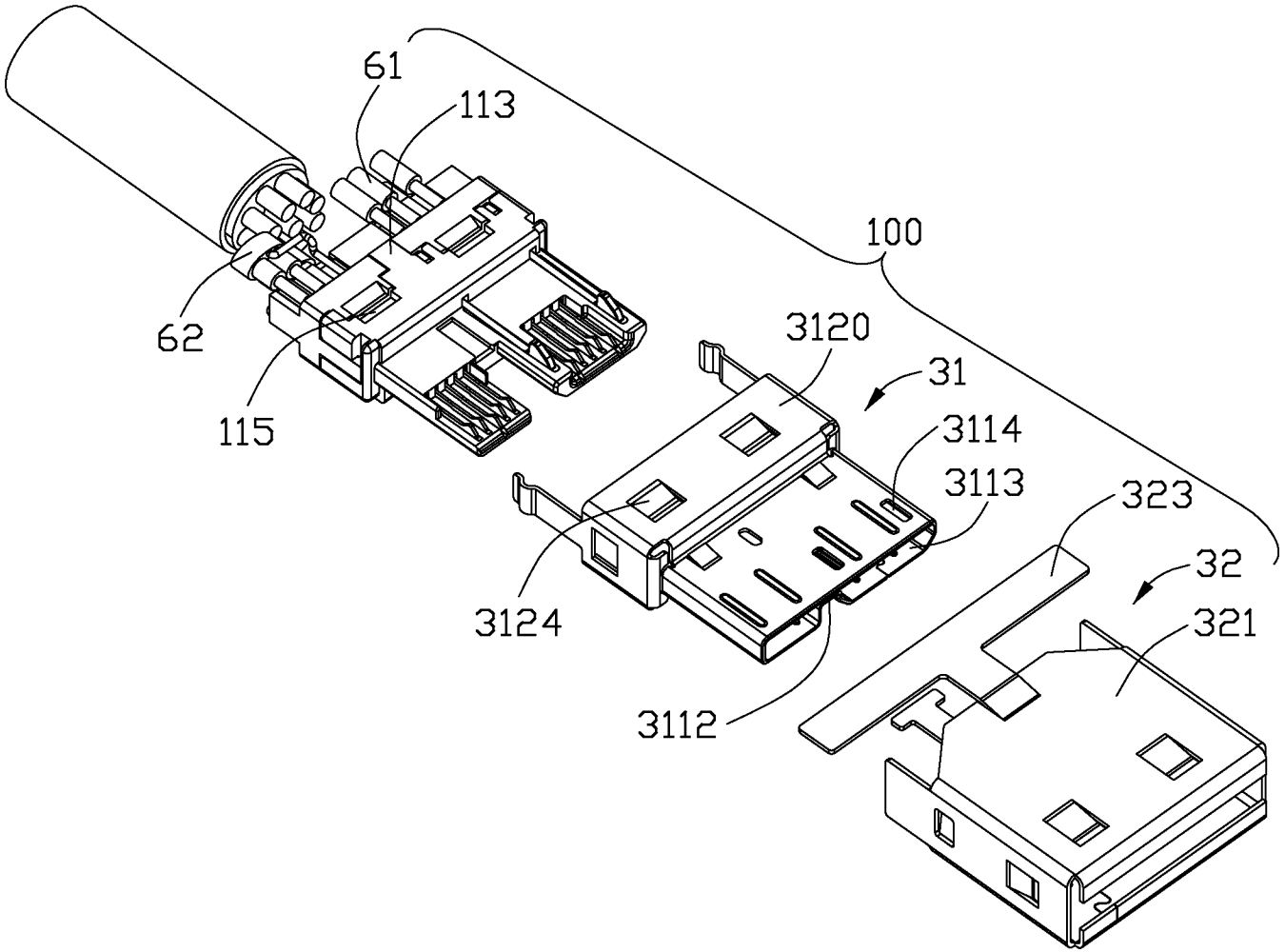
FIG. 3 is a partially assembled, perspective view of the cable connector assembly shown in FIG. 1.
Figure 4:
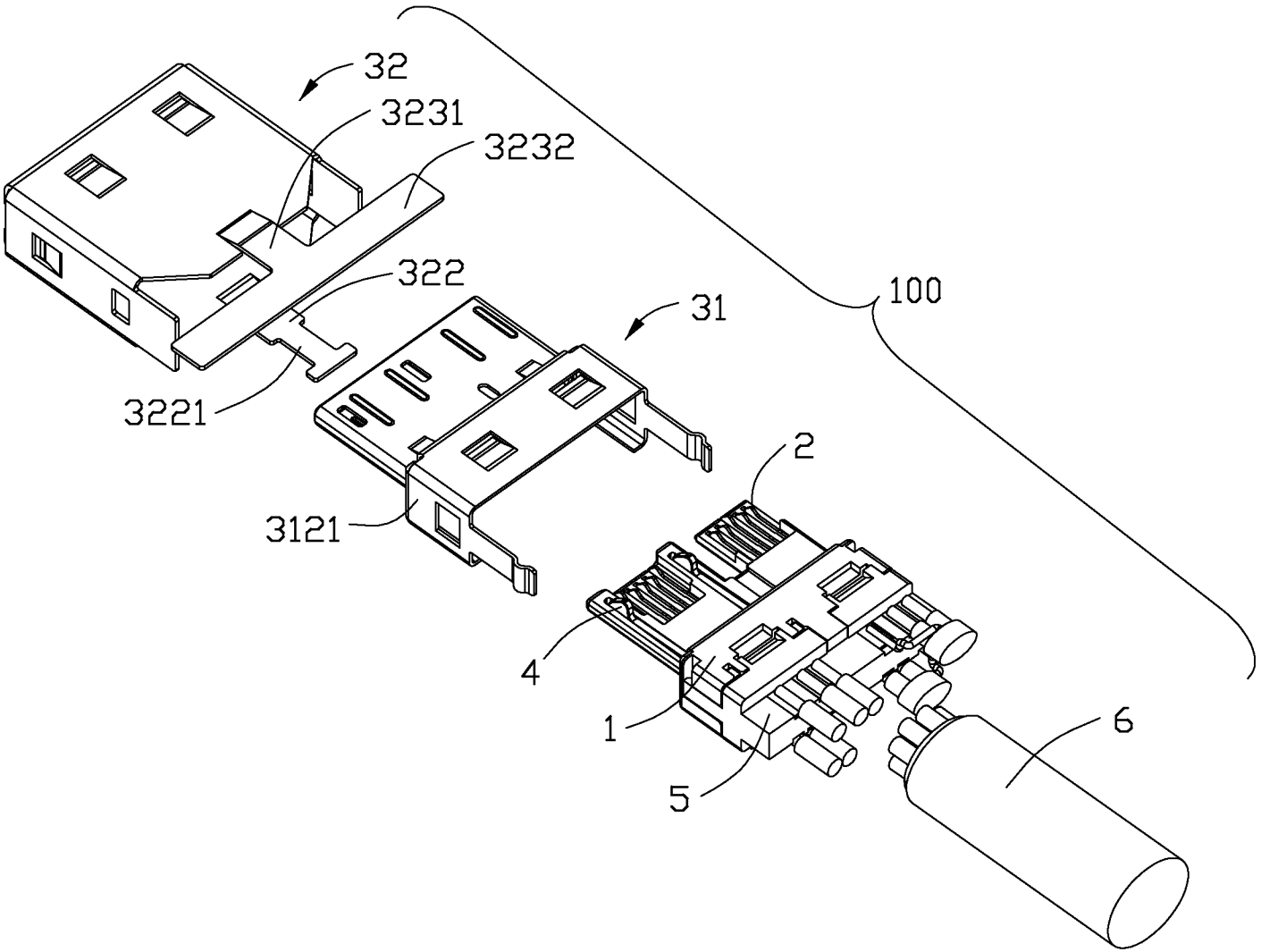
FIG. 4 is a view similar to FIG. 3, but viewed from a different aspect.
Figure 5:
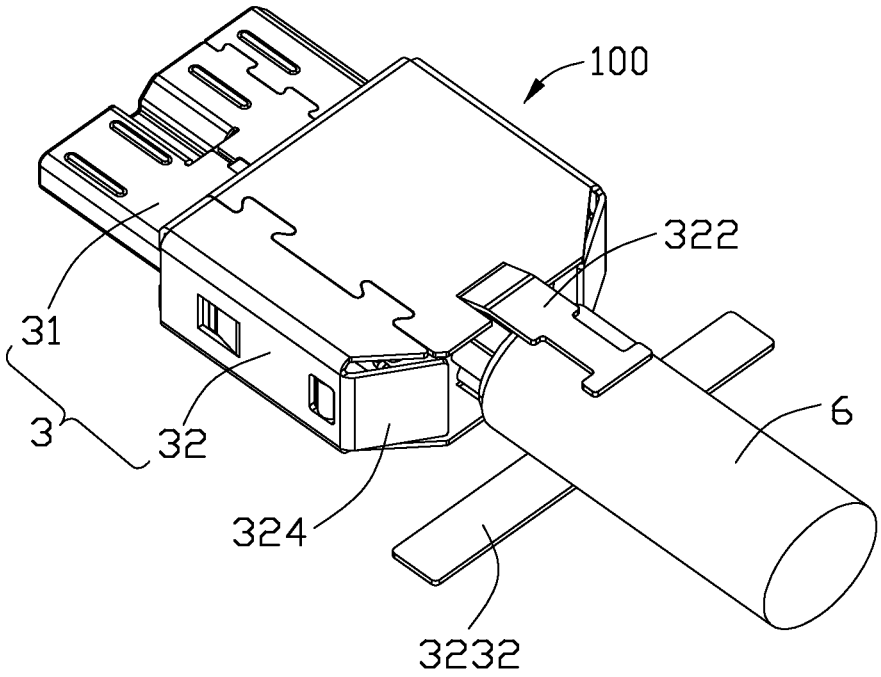
FIG. 5 is an assembled, perspective view of the cable connector assembly shown in FIG. 1.

Referring to FIGS. 1-5, a cable connector assembly 100 made in accordance with the present invention comprises an insualtive housing 1, a plurality of contacts 2 held in the insulative housing 1, a metallic shell 3 enclosing the insualtive housing 1, a pair of latches 4 retained in the insulative housing 1 and exposed out of the metallic shell 3, a spacer 5 fastened to the insulative housing 1 to support contacts 2 and a cable 6 electrically connected with the contacts 2.

Figure 6:
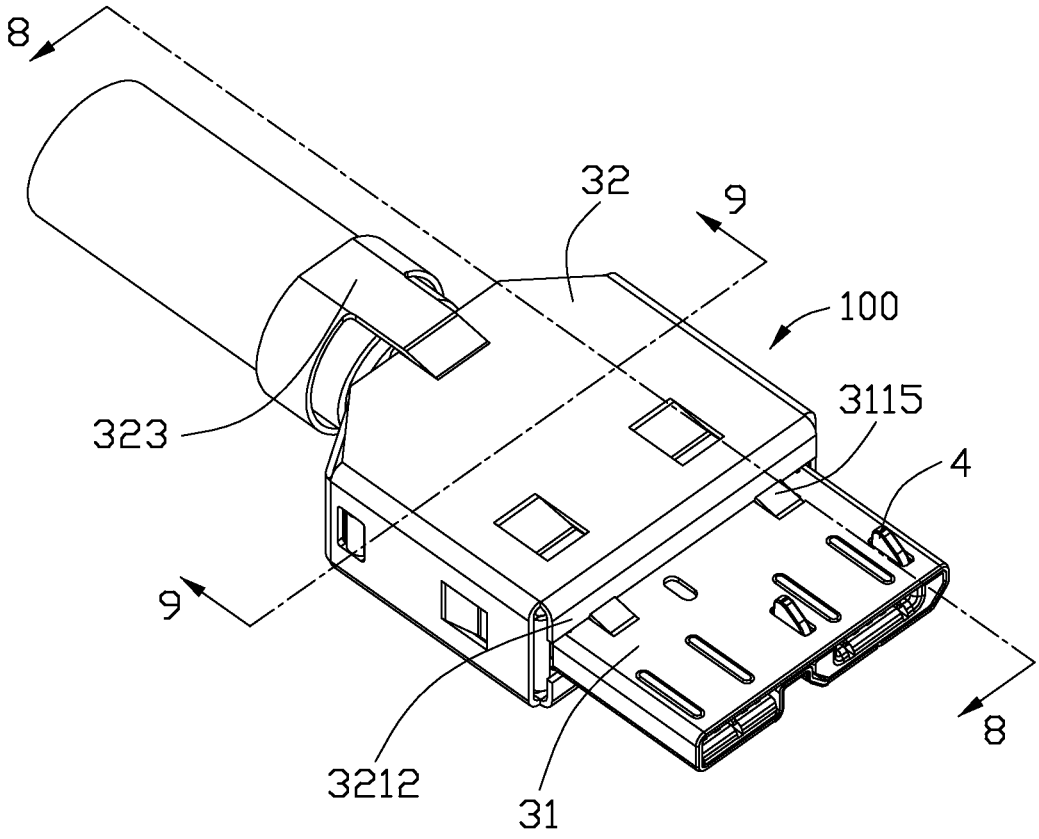
FIG. 6 is an assembled view when a metallic shell enclosing a cable shown in FIG. 6.
Figure 7:
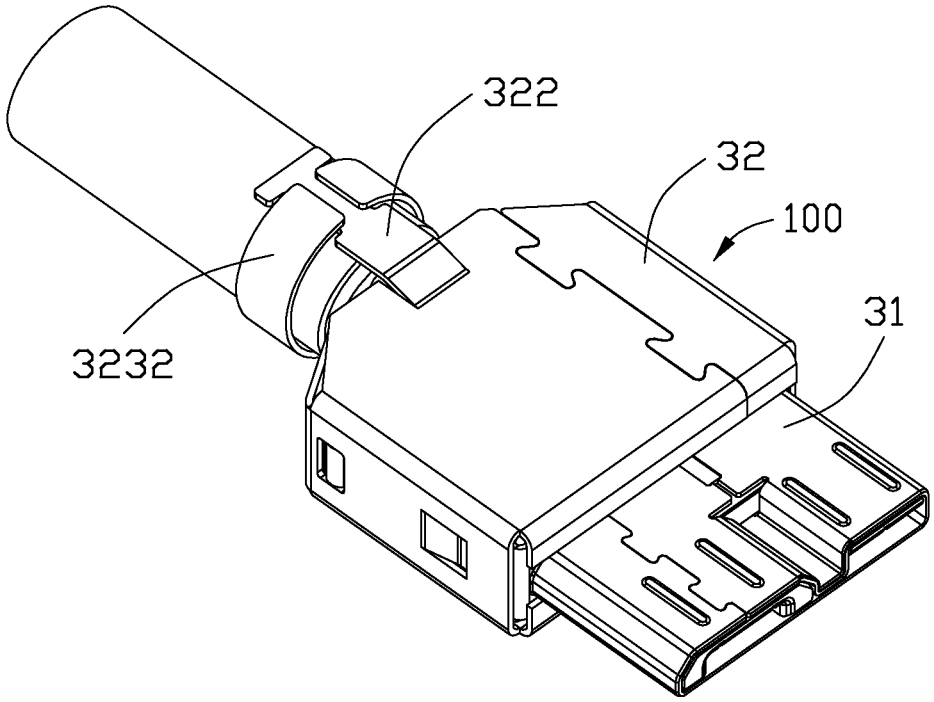
FIG. 7 is a view similar to FIG. 6, but viewed from a different angle.
Figure 8:
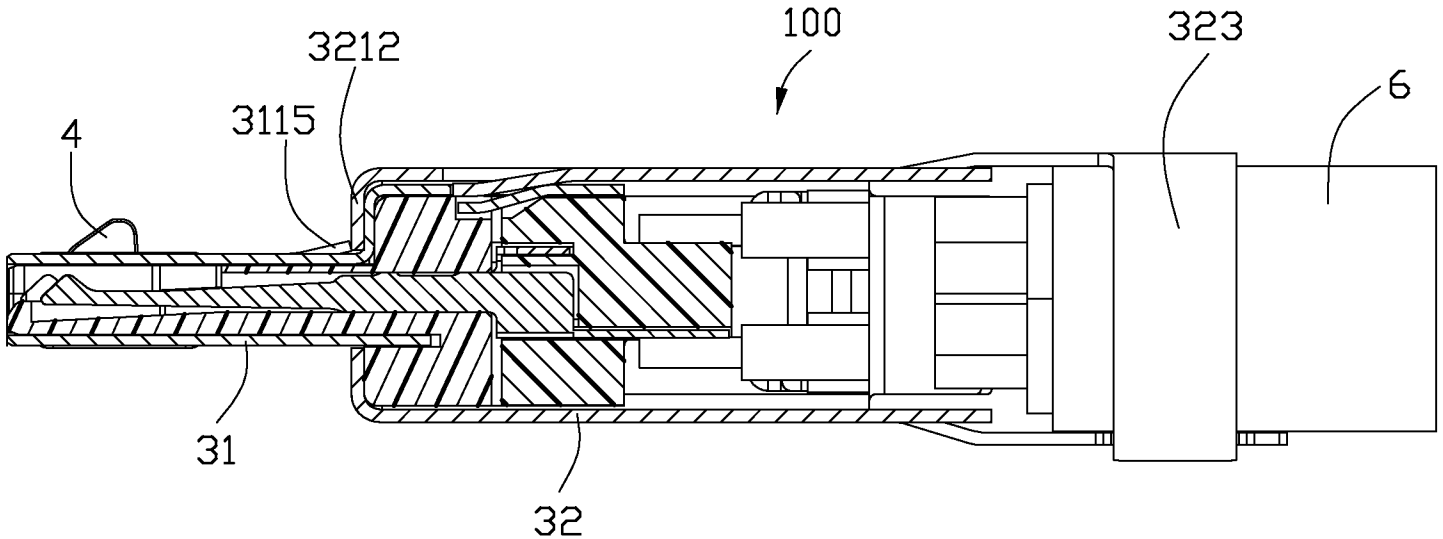
FIGS. 8-9 are cross-section views taken along lines 8-8 to 9-9 of FIG. 6.
Figure 9:
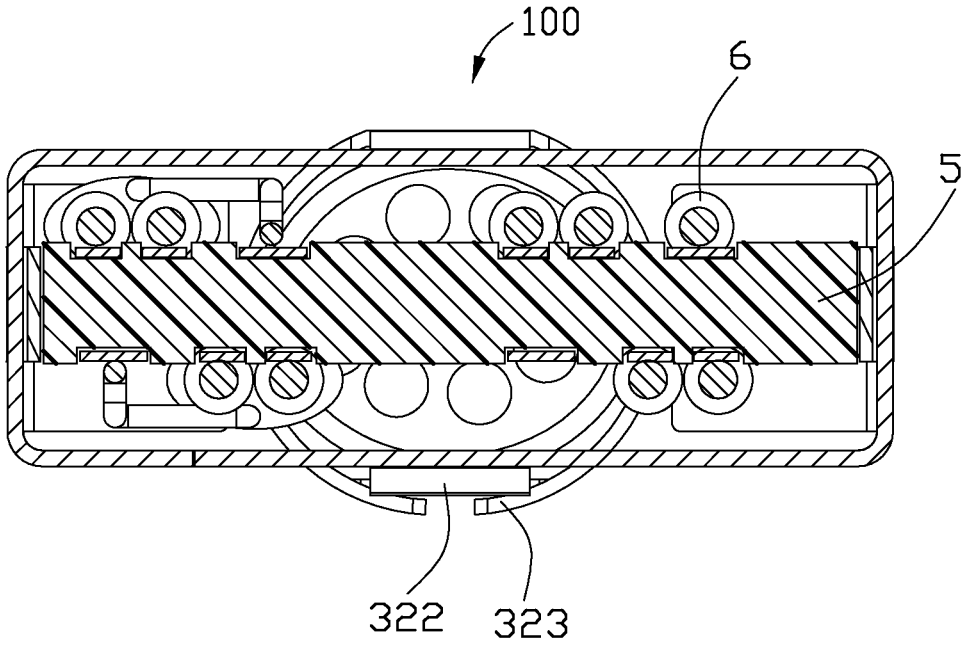

Referring to FIGS. 2-9, the insulative housing 1 includes a base portion 11 and a tongue portion 12 integrally extending forwardly beyond the base portion 11. The tongue portion 12 is split into a first tongue 121 and a second tongue 122 side by side arranged with each other and disposed in a common plane. The first tongue 121 is wider than the second tongue 122. The base portion 11 has a pair of lateral walls 112 opposite to each other, and each lateral wall 112 defines a first slot 1121 along a mating direction and a second slot 1122 perpendicular to the first slot 1121. The second slot 1122 is communicated with the first slot 1121 and deeper than the first slot 1121. The base portion 11 defines a pair of tabs 113 protruding rearwards from a back end thereof, and the two tabs 113 are arranged opposite to each other along a direction perpendicular to the mating direction. The base portion 11 defines a pair of outlets 114 recessed forwardly from the back end thereof.

The first tongue 121 and the second tongue 122 are located on a same horizontal level, to make sure the cable connector assembly 100 with a low profile, and the size of the first tongue 121 is accordance with USB 2.0 standard. The first tongue 121 has a first rear segment 1210 mechanically connected with the base portion 11 and a first front segment 1212 away from the base portion 11. Relative to the first tongue 121, the second tongue 122 defines a second rear segment 1220 and a second front segment 1222. The first rear segment 1210 and the second rear segment 1220 are of a unitary configuration to make the tongue portion 12 stable, and the first front segment 1212 and the second front segment 1222 are spaced apart from each other to form two independent mating ports.

The first tongue 121 defines a plurality of first passages 1213 parallel to each other, the first passages 1213 are extending along the mating direction, and extending through the base portion 11. A pair of channels 1214 are defined on lateral sides of the first passages 1213 to receive the latches 4, and the channels 1214 are extending through the base portion 11.

Similar to the first tongue 121, the second tongue 122 defines a number of second passages 1223 parallel to the first passages 1213, and the second passages 1223 are extending through the base portion 11.

The contacts 2 include a plurality of first contacts 21 and a plurality of second contacts 22, and the first contacts 21 are received in the corresponding first passages 1213 with the second contacts 22 received in the corresponding second passages 1223. The first contacts 21 are compatible to version 2.0 Micro Universal Serial Bus. Each contact 2 comprises a contacting portion 23 extending along the mating direction, a retaining portion 24 extending rearwards from the contacting portion 23, and a tail portion 25 bent downwards or upwards from the retaining portion 24. The tail portion 25 is located in a horizontal plane.

The second contacts 22 include five conductive contacts, and the middle one of the second contacts 22 is a grounding contact, a pair of signal contact for transmitting high speed signal and a pair of signal contacts for receiving high speed signal are located on both sides of the grounding contact. The grounding contact has a pair of soldering portions on an upper side and a lower side of a rear section.

The first contacts 21 also include five conductive contacts, and the middle one of the first contacts 21 is a signal contact, the signal contact of the first contacts 21 and the grounding contact of the second contacts 22 have the same configuration with each other, so the first contacts 21 have six soldering portions arranged on two levels for preventing cross-talk.

The metallic shell 3 includes a shielding member 31, and an outer shell 32. The shielding member 31 comprises a sleeve portion 311 in the front thereof, an engaging portion 312 extending rearwards from the sleeve portion 311, and a pair of arm portions 313 extending rearwards from both sides of the engaging portion 312. The arm portions 313 are opposite to each other, and each arm portion 313 has an arc-shaped arch 3132 on a free end thereof. The sleeve portion 311 defines a depression 3112 relative to a gap between the first front segment 1212 and the second front segment 1222, and the depression 3112 is divided the sleeve portion 311 into two mating cavities 3113 for receiving the first tongue 121 and the second tongue 122. The sleeve portion 311 defines a pair of notches 3114 receiving the latches 4. The engaging portion 312 is of U-shape, and comprises a bottom wall 3120 and a pair of side walls 3121 connected with the bottom wall 3120, each side wall 3121 defines a locking hole 3123, and the arm portions 313 extends backwards from corresponding side walls 3121. A pair of elastic portions 3124 are defined on the bottom wall 3120.

The outer shell 32 comprises a conjoint portion 321 with a tube shape, the conjoint portion 321 has a joining line 3210 on an upper wall thereof. The outer shell 32 defines a continued portion 322 extending backwards from an upper surface thereof, and a T-shaped fixing portion 323 opposite to the continued portion 322. The continued portion 322 is of T-shape, and has a larger length than the fixing portion 323 along the mating direction. A pair of cutouts 3221 are formed on both sides of the continued portion 322, and the cutouts 3221 are opposite to each other and neighboring to a free end of the continued portion 322. The fixing portion 323 has a clipping portion 3232 on a free end thereof, and the clipping portion 3232 extends along a transverse direction. The clipping portion 3232 is connected with the conjoint portion 321 via a linking portion 3231 extending along the mating direction, and opposite ends of the clipping portion 3232 are bent towards each other to clamp the cable 6.

Each latch 4 comprises a retaining standoff 41 held in the base portion 11 of the insulative housing 1 and an engaging arm 42 extending forwards from the retaining standoff 41, the engaging arm 42 is received in the relative channel 1214 of the insulative housing 1.

The spacer 5 is made of insulative material, and comprises a primary portion 51, an extension portion 52 extending backwards from a rear end of the primary portion 51, a pair of rectangular protrusions 53 extending forwards from a front end of the primary portion 51 and a pair of elongate arms 54 extending forwards from lateral sides of the primary portion 51. The primary portion 51 defines a pair of openings 512 on a top and a bottom surface thereof, the openings 512 are defined neighboring to a middle area of the primary portion 51, and divides the primary portion 51 into two segments. A plurality of grooves 521 are defined on a top surface and a bottom surface of the extension portion 52, for receiving the tail portions 25 of the contacts 2, and there are six grooves 521 defined on the top surface and the bottom surface respectively, and the six grooves 521 on the same surface are equally divided into two groups by the opening 512. The protrusions 53 have a top plane coplanar to an upper surface of the primary portion 51, and a bottom plane of the protrusions 53 is coplanar to a lower surface of the primary portion 51. Each protrusion 53 comprises a plurality of gateways (not shown) recessed from a front end thereof along a front-to-back direction, and the gateways are defined in a vertical direction. Each elongate arm 54 defines a tuber 541 on a front end thereof for assorting with the corresponding lateral wall 112 of the insulative housing 1. A block 55 is disposed on a front end of the spacer 5, and located between the pair of protrusions 53, the block 55 has a small size.

The cable 6 is divided into two groups, and the first group comprises a number of individual wires 61 connected with the first contacts 21, and the second group comprises two STP (Shielded Twisted Pair) wires 62 for high speed signal transmission.

In assembly, the contacts 2 are inserted into the insulative housing 1 along a back-to-front direction, the first contacts 21 and the second contacts 22 are accommodated in the first passages 1213 of the first tongue 121 and the second passages 122 of the second tongue 122 respectively, the latches 4 are inserted into the channels 1214 of the first tongue 121. The tail portions 25 of the contacts 2 are exposed beyond the insulative housing 1. Then the spacer 5 is assembled to a back end of the insulative housing 1 along the back-to-front direction, the elongate arms 54 on both sides of the spacer 5 are sliding in the first slots 1121 of the insulative housing 1, until the tubers 541 of the elongate arms 54 locked in the second slots 1122. The protrusions 53 of the spacer 5 are accommodated in the corresponding outlets 114 of the insulative housing 1, to prevent the spacer 5 moving relative to the insulative housing along a transverse direction. The block 55 of the spacer 5 is interferentially cooperated with an indentation (not labeled) on the back end of the insulative housing 1. The pair of tabs 113 of the insulative housing 1 are inserted into the corresponding openings 512 of the spacer 5. A pair of matching holes 115 are formed on a conjunction area between a front end of the bottom plane of the spacer 5 and the back end of the housing 1.

The contacts 2 are inserted into the gateways of the spacer 5 respectively, and the tail portions 25 are exposed in the grooves 521 of the extension portion 52. The wires 61 of the cable 6 are soldered to corresponding tail portions 25 of the first contacts 21, the STP wires 62 are electrically connected with the second contacts 22.

Then the insulative housing 1 is assembled into the shielding member 31, the tongue portion 12 of the insualtive housing 1 is received in the sleeve portion 311 of the shielding member 31, and the first tongue 121 and the second tongue 122 are received in the mating cavities 3113 respectively. The two mating cavities 3113 can prevent the first and second front segment 1212, 1222 swaying. The engaging arms 42 of the latches 4 are received in the notches 3114 and exposed out of the shielding member 31. The elastic portions 3124 on the shielding member 31 are locked in the corresponding matching holes 115 formed by the spacer 5 and the insulative housing 1.

Then the aforementioned components are assembled into the outer shell 32, the conjoint portion 321 of the outer shell 32 is enclosing the engaging portion 312 of the shielding member 31, a pair of stopping portions 324 on both sides of the outer shell 32 are bent towards each other. A pair of nose portions 3115 on the sleeve portion 311 of the shielding member 31 are adjacent to a front flange 3212 of the conjoint portion 321. The clipping portion 3232 is curved to enclose the cable 6, and free ends of the clipping portion 3232 are pressing on the continued portion 322, part of the clipping portion 3232 is received in the cutouts 3221 of the continued portion 322.

The shielding member 31 is assembled into the outer shell 32 to enclose the insulative housing 1 and an electrical connection between the contacts 2 and the cable 6. Thus, the cable connector assembly 100 is assembled.

The cable connector assembly 100 is compatible to standard USB 2.0 connector. The size of the first tongue 121 and the arrangement of the first contacts 21 are in accordance with USB 2.0 plug connector standard.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing including a base portion and a first tongue and a second tongue extending forwardly from the base portion;

a plurality of contacts received in the insulative housing and held in the first tongue and the second tongue;

a cable electrically connected with the contacts; and a metallic shell enclosing the insulative housing;

wherein the metallic shell comprises a shielding member and an outer shell combined with the shielding member, the outer shell has a continued portion and a T-shaped fixing portion both integrally extending backwardly from two opposing sides thereof, the fixing portion has a clipping portion extending along a transverse direction on a free end thereof, and opposite free ends of the clipping portion are bent towards each other to clamp the cable while pressing on the continued portion; wherein the outer shell has a conjoint portion with a tube shape; wherein the shielding member comprises a front sleeve portion and a rear engaging portion, and the conjoint portion of the outer shell encloses the engaging portion; wherein the engaging portion is U-shaped and comprises a bottom wall and a pair of side walls connected with the bottom wall; wherein a pair of elastic portions are defined on the bottom wall, a pair of matching holes are formed by a spacer and the insulative housing, and the elastic portions are locked in the corresponding matching holes.

2. The cable connector assembly as claimed in claim 1, wherein the sleeve portion defines a pair of nose portions on a rear end thereof, and the nose portions are adjacent to a front flange of the conjoint portion.

3. The cable connector assembly as claimed in claim 1, wherein the clipping portion is connected with the conjoint portion via a linking portion extending along a mating direction.

4. The cable connector assembly as claimed in claim 3, wherein the outer shell defines a pair of stopping portions on both sides thereof, and the stopping portions are bent towards each other.

5. The cable connector assembly as claimed in claim 1, further comprising a spacer assembled to the insulative housing and supporting the contacts, the spacer defines a pair of openings on a top and a bottom surface thereof, and the insulative housing defines a pair of tabs protruding rearwards from a back end thereof, the tabs are inserted into the corresponding openings of the spacer.

6. The cable connector assembly as claimed in claim 1, wherein the continued portion defined a pair of cutouts on both sides thereof, the cutouts are opposite to each other and neighboring to a free end of the continued portion.

7. The cable connector assembly as claimed in claim 6, wherein free ends of the clipping portion are abut against the cutouts of the continued portion.

8. A cable connector assembly comprising:

an insulative housing defining a rear base portion and a front mating tongue extending forwardly from the base portion in a front-to-back direction;

a plurality of contacts disposed in the housing with front contacting sections exposed upon the front mating tongue, and rear tail sections;

a round cable including a plurality of wires respectively electrically connected to the rear tail sections of the corresponding contacts;

a shell device enclosing said housing and including a front shell and a rear shell assembled to each other, the front shell defining a front sleeve portion enclosing the front mating tongue, and a rear engaging portion enclosing the rear base portion, the rear shell defining a tubular main body receiving the rear engaging portion and the rear tail sections; and a fixing portion unitarily extending rearwardly from the main body to circumferentially crimp the round cable; wherein said rear shell further includes a continued portion extending rearwardly from the main body opposite to said fixing portion in a vertical direction perpendicular to said front-to-back direction; wherein the main body defines a narrowed front opening through which the sleeve portion extends forwardly; wherein the main body defines an upper front edge and a lower front edge along a transverse direction perpendicular to both said front-to-back direction and said vertical direction, and a pair of flanges extend from said upper front edge and said lower front edge, respectively, toward each other in the vertical direction, to form said narrowed front opening; wherein said continued portion defines a neck to receive the fixing portion therein for preventing relative movement therebetween in the front-to-back direction.

9. The cable connector assembly as claimed in claim 8, wherein the fixing portion includes a T-shaped structure with a lengthwise bar and a transverse bar.

10. The cable connector assembly as claimed in claim 9, wherein the continued portion including another T-shaped structure with another lengthwise bar longer than said lengthwise bar of the fixing portion, and another transverse bar shorter than the transverse bar of the fixing portion.

11. The cable connector assembly as claimed in claim 8, wherein said rear engaging portion defines essentially a U-shaped cross-section with a main wall and two side walls, and the fixing portion is intimately neighboring to the main wall.

12. The cable connector assembly as claimed in claim 8, wherein said rear engaging portion defines essentially a U-shaped cross-section with a main wall and two side walls, and a pair of arm portions extending rearwardly from the corresponding side walls in a cantilevered manner, respectively, to engage the main body.

13. A cable connector assembly, comprising:

an insulative housing including a base portion and a first tongue and a second tongue extending forwardly from the base portion;

a plurality of contacts received in the insulative housing and held in the first tongue and the second tongue;

a cable electrically connected with the contacts; and a metallic shell enclosing the insulative housing;

wherein the metallic shell comprises a shielding member and an outer shell combined with the shielding member, the outer shell has a continued portion and a T-shaped fixing portion both integrally extending backwardly from two opposing sides thereof, the fixing portion has a clipping portion extending along a transverse direction on a free end thereof, and opposite free ends of the clipping portion are bent towards each other to clamp the cable while pressing on the continued portion; wherein the outer shell has a conjoint portion with a tube shape; wherein the shielding member comprises a front sleeve portion and a rear engaging portion, and the conjoint portion of the outer shell encloses the engaging portion; wherein the engaging portion is U-shaped and comprises a bottom wall and a pair of side walls connected with the bottom wall; wherein the sleeve portion defines a pair of nose portions on a rear end thereof, and the nose portions are adjacent to a front flange of the conjoint portion.

* * * * *